US005746650A

United States Patent [19]

Johnson et al.

[11] Patent Number: 5,746,650

[45] Date of Patent: May 5, 1998

[54] INTEGRATED PAINT SPRAY BOOTH AND AIR CONDITIONING SYSTEM AND PROCESS

[75] Inventors: Jeffrey Johnson, Beverly Hills; Daniel M. St. Louis, MaComb, both of Mich.

[73] Assignee: Haden, Inc., Auburn Hills, Mich.

[21] Appl. No.: 507,930

[22] Filed: Jul. 27, 1995

[51] Int. Cl.[6] ..... B05B 15/12

[52] U.S. Cl. ..... 454/52; 62/171; 454/54

[58] Field of Search ..... 454/50, 51, 52, 454/53, 54, 55; 118/326; 62/171; 261/98

[56] References Cited

U.S. PATENT DOCUMENTS

| | | | |
|---|---|---|---|
| 1,520,267 | 12/1924 | Waltz | 454/55 |
| 4,173,924 | 11/1979 | Bradshaw | 454/53 X |
| 4,197,714 | 4/1980 | Bradshaw | 62/94 |
| 4,222,319 | 9/1980 | Donahue . | |
| 4,367,787 | 1/1983 | Bradshaw | 454/50 X |
| 4,386,733 | 6/1983 | Bradshaw . | |
| 4,537,120 | 8/1985 | Josefsson | 454/54 X |
| 4,687,686 | 8/1987 | Stofleth et al. | 454/52 X |
| 4,704,952 | 11/1987 | Johnson et al. . | |
| 5,460,569 | 10/1995 | Josefsson | 454/54 X |

*Primary Examiner*—Harold Joyce
*Attorney, Agent, or Firm*—Niro, Scavone, Haller & Niro

[57] ABSTRACT

An integrated paint spray booth and air conditioning system and process utilize a spray booth housing, scrubber and filtering chambers located below the housing, and an air conditioning apparatus including an adiabatic saturator. The components are arranged to direct the air flow in the system substantially transverse to the length of the system. The air is conditioned to predetermined psychrometric values by sensing only the temperature of the water entering the saturator and the air exiting the conditioning apparatus.

6 Claims, 2 Drawing Sheets

INTEGRATED PAINT SPRAY BOOTH AND AIR CONDITIONING SYSTEM AND PROCESS

BACKGROUND OF THE INVENTION

The present invention relates generally to an integrated spray booth system. More specifically, the present invention is directed to an integrated paint spray booth and air treatment apparatus that introduces air into the spray booth under preselected psychrometric conditions to facilitate proper paint application, while minimizing the size and space required for the facility. This system minimizes the amount of duct work within the facility and eliminates the need for a separate air supply house to control the quality of air flow into the spray booth. The invention finds particularly advantageous application in spray painting of automobiles.

Recently, increasing environmental concerns and federal regulations have sought to limit the emission of volatile organic compounds ("VOC's"). One way in which VOC's can be emitted from a paint facility is through the discharge of unused or oversprayed solventborne paint. In response to this problem, manufacturers have further developed their use of alternative waterborne and airborne powder paints.

However, more specific and more stringent psychrometric values are required for the air used in waterborne and powder paint spray booth applications. This demand is due to the comparatively narrow window of psychrometric conditions that are acceptable for waterborne and powder paint applications.

Various techniques have been developed to provide temperature and humidity control systems for such applications. However, these previous systems have addressed the monitoring and maintenance of both the desired relative humidity and temperature levels for the air within the controlled system. These multi-variable processes require complex control systems to achieve the predetermined psychrometric conditions for introduction into the spray booth. These systems or "air supply houses" are also relatively large structures taking approximately one third of the space required for the spray booth, itself, and adding additional floors above the spray booth, thus decreasing the practicality and cost effectiveness of the overall paint facility. Further, previous air supply control systems have proven difficult to operate in both summer and winter conditions (i.e. with inlet air having either a significantly higher or lower temperature and/or humidity than the desired application conditions).

Another disadvantage of existing air supply houses or systems is that it is difficult to efficiently modify the system in the event that the spray booth itself needs modification. A typical automotive spray booth may be 100 feet or more in length. If a modification to the booth requires increasing its length by some relatively small increment, for example 15 to 20 feet, it may require a complete rework of the air supply house, since these systems are not necessarily incrementally modifiable. Thus, an air supply system which is modular in design, one that can be incrementally enlarged with an enlargement of the base spray booth, would be desirable.

A need, therefore, exists for an effective paint spray booth and air conditioning system that is relatively small and compact, is capable of positioning on one floor level, and is of modular construction.

SUMMARY OF THE INVENTION

The present invention is directed to a unique arrangement of component equipment that together constitutes a compact, space efficient integrated paint spray booth and air conditioning system. The system comprises an elongated spray booth, a scrubber chamber, a filtering chamber, an air duct for transferring air discharged from the filtering chamber back to the spray booth, air conditioning means in fluid communication with the duct for treating the air to obtain a proper temperature and humidity, and an air circulation means.

The spray booth is comprised of an elongated housing having opposed sidewalls, and a top and bottom configured to accommodate an air flow passing down through the paint application zone. The scrubber and filtering chambers are arranged side-by-side beneath the spray booth housing, with the necessary banks of air filters disposed longitudinally and generally parallel to the length of the spray booth. Consequently, the air flow through the system is directed generally transverse to the length of the spray booth, and the air flow travels a common distance through the system regardless of the particular length of the system or the particular longitudinal location within the system.

One embodiment of the present invention utilizes an adiabatic spray tower for saturating the air stream with water set at a preselected temperature such that the airstream exiting the tower is at a temperature approximately equal to the water inlet temperature and has approximately 100% relative humidity. Furthermore, the air stream entering the tower can be comprised of 0–90% by volume recirculated air. The air exiting the saturation is then reheated with a substantially constant amount of heat in order to provide the air stream with the necessary psychrometric conditions for the desired paint application.

Thus, the integrated system of the present invention provides an air supply with precise temperature and relative humidity levels without the use of humidity process controls. Further, the integrated adiabatic saturator combines a desirable additional scrubbing step with the necessary step of humidifying the air stream prior to reentry into the spray booth.

Accordingly, it is an object of the invention to provide a integrated spray paint booth and air supply system.

A further object of the invention is to provide a system for adiabatic saturation of an air stream for use with spray paint booth applications.

A further object of our invention is to provide an integrated system that minimizes space, size and cost requirements for paint spray booth systems.

Still a further object of the present invention is to eliminate multilevel requirements that are normally encountered with spray booth and air supply systems.

Still another object of the present invention is to provide a compact integrated paint spray booth and air conditioning system that is truly modular in design, permitting incremental changes in spray booth length which require only like incremental changes in the air conditioning system.

BRIEF DESCRIPTION OF THE DRAWINGS

The novel features which are characteristic of the present invention are set forth in the appended claims. The invention itself, however, together with further objects and attendant advantages, will be best understood by reference to the following description taken in connection with the accompanying drawings in which:

DETAILED DESCRIPTION OF THE PREFERRED EMBODIMENT

Figure 1:
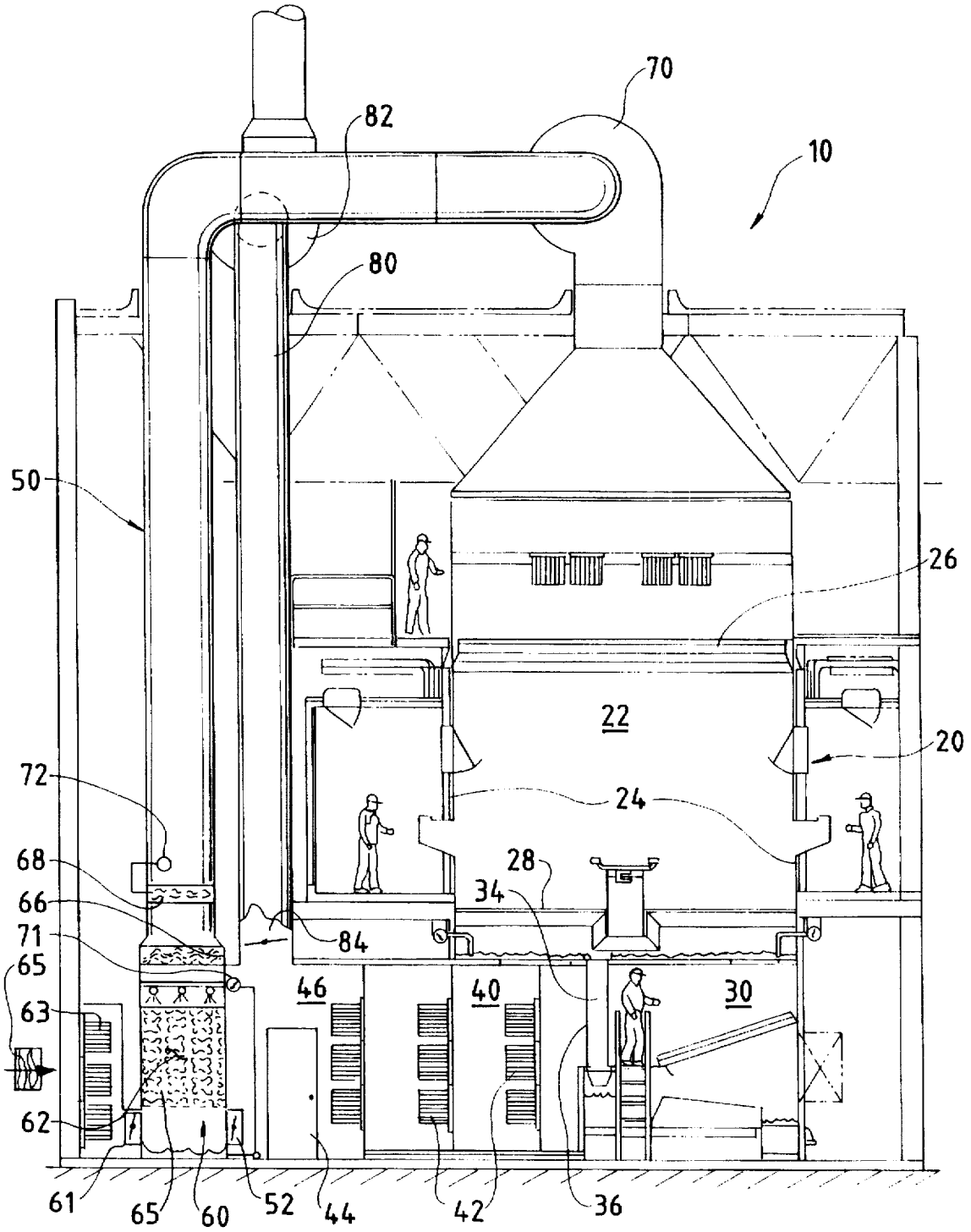
FIG. 1 shows a schematic, cross-sectional view of the integrated spray booth and air conditioning system of the present invention.

The integrated paint spray booth and air conditioning system of the present invention is designated generally as 10 and is schematically illustrated in FIG. 1. The system 10 includes as its basic components a spray booth housing 20, a scrubber chamber 30, a filtering chamber 40, a duct 50, an air conditioning apparatus 60, and an air circulating means 70.

The spray booth housing 20 defines a paint application zone 22 through which the automotive bodies or other articles to be painted pass sequentially. The housing is comprised of opposing side walls 24, and a top 26 and bottom 28 each of which includes one or more air passages to accommodate a downward flow of the air through the paint application zone 22. An example of a paint spray booth which is suitable for use in the practice of the present invention is illustrated and described in U.S. Pat. No. 4,222,319, the disclosure of which is incorporated herein by reference.

The scrubber chamber 30 extends longitudinally beneath the paint spray booth housing 20 and includes an inlet comprised of a plurality of longitudinally spaced cylinders 34 which receive air discharged from the spray booth. Again, the scrubber chamber 30 can take form in any of a variety of designs well known to those of skill in the art, including, for example, the scrubber chamber apparatus as illustrated in U.S. Pat. No. 4,222,319. Preferably, the scrubber chamber is sized to run the longitudinal length of the spray booth housing 20 but occupies approximately one-half of the width of the spray booth, terminating in a scrubber outlet 36 that extends longitudinally below the spray booth 20.

The air flow exiting the scrubber chamber 30 enters into filtering chamber 40 and passes through a plurality of filter elements 42 which are arranged in longitudinally extending banks that run generally parallel to the length of the spray booth housing. One or more service access doors 44 are located in filtering chamber 40, providing convenient access to the filter banks. Down stream of the air filters 42 on the side of the filtering chamber opposite to the scrubber chamber is a discharge plenum 46 in fluid communication with duct 50. Duct 50, in turn, includes an inlet 52 communicating with a vertical standing section that extends to a height sufficient to permit the circulation of air to the top of the spray booth 20.

An air conditioning apparatus 60 is utilized in fluid communication with duct 50 to properly condition the air with respect to both temperature and humidity as the paint spray operation requires. An air circulation means 70, such as a conventional blower, has its supply side in communication with the duct 50 and discharges properly conditioned air into the top of spray booth housing 20.

It will be apparent from the foregoing description that the air path throughout the integrated paint spray booth and air conditioning system 10 is in a direction generally transverse to the longitudinal length of the spray booth housing 20. Thus, the length of travel of the air flow as it circulates from the bottom of the spray booth through the scrubber and filtering chambers and duct work back to the top of the spray booth 20 is substantially constant throughout the length of the spray booth system. As a consequence, the size of the blowers utilized, the size of the filters, the cross-sectional area of the required duct work, and the capacity of the air conditioning system is constant for each incremental length of spray booth. In this fashion, a reduction in the length of the spray booth or increase in the length of the spray booth simply requires a reduction or increase, respectively, in the amount of air conditioning apparatus of a size and capacity as is already used in the original equipment and system. A modular design is thereby achieved permitting incremental changes in spray booth size which are easily accommodated by like incremental changes in the air conditioning systems size.

In accordance with the present invention, the air conditioning system 60 is preferably comprised of an adiabatic saturator 62 which accommodates a downward flow of water provided by spray nozzles 64 to thereby properly condition the upwardly flowing air mass through the saturator to a prescribed and predetermined temperature and humidity. In addition, a demister 66 and a reheater 68 may be positioned downstream, and in the case of FIG. 1 above, the adiabatic saturator 62. By simply spraying water into the plenum or duct 50, the adiabatic saturation of the air stream can be achieved. One advantage of this preferred embodiment is that it generates a relatively small pressure drop, thus resulting in lower operating costs.

The saturator 62 receives recirculating air from filtering chamber 40 and ideally extends along the length of the spray booth to facilitate the even distribution of conditioned air. A fresh air stream may also be introduced via damper 61 and filters 63 into saturator 62 and mixes with the circulating air in the system and the downward flowing water stream. If necessary, a heater 65 may be utilized in order to raise the temperature of incoming fresh air during periods of extreme cold winter conditions.

In an alternative embodiment of the present invention, the adiabatic saturation of the supply air takes place in a tower containing packing elements 65. The plastic packing elements 14 may be of the type disclosed in U.S. Pat. No. 4,668,442 and sold as Lanpac® Tower Packing by Lantec Products Inc. of Agoura Hills, Calif. This packing element is preferred for use with the present invention because of its high scrubbing efficiency and its resistance to fouling or plugging.

Through the use of this adiabatic saturation process, the air supply stream develops a relative humidity of 100% and a temperature approximately equal to the water stream temperature which is set at the desired saturation temperature. The air supply stream then passes through the demister 66 that removes water droplets carried by the air stream. Next, the air supply stream passes through the heat exchanger 68 to bring the air to the desired preselected dry bulb temperature and relative humidity, thus placing the air supply within the desired psychrometric "window." The air supply then circulates through duct work 50 by means of fan 70. The fan then directs the air supply into a supply plenum at the top of spray booth housing 20 and additional filters, if necessary.

An exhaust duct 80 may also be employed, and is preferably located to communicate with the air system at plenum 46 between filtering chamber 40 and the inlet 52 to duct 50. An exhaust fan 82 discharges the exhausted air to atmosphere or other processing. Automatically controlled dampers 61 and 84 can be employed to balance the air flow in the system by adjusting the quantity of fresh air introduced into the system and/or the quantity of system air that is exhausted.

In accordance with the preferred embodiment of the present invention, scrubber chamber 30, filtering chamber 40, plenum 46 and air conditioning means 60 may extend continuously along the length of spray booth housing 20. However, one or more of these components of the system may be interrupted or constructed in discrete lengths less than that of the entire spray booth. By way of example, the air conditioning means 60 may take the form of a plurality of individual adiabatic saturator towers, each positioned at a discrete point or spaced intervals along the length of the spray booth housing 20 and intended to service an adjacent localized length of the system. So too, duct 50 will typically be constructed in the form of individual risers that communicate with air conditioning means 60 and the supply plenum mounted above the top 26 of spray booth housing 20.

It should be noted that the air conditioning system is preferably positioned at the same level as the spray booth and scrubber. A common base floor is used. Thus, the air conditioning system provides an integral means of controlling the air supply for the spray paint booth 20 without adding additional floors or substantial new floor space. Further, the positioning of the duct 50 relative to the spray booth 20 permits the desired vertical counterflow between the air stream and the water within the adiabatic saturator. This vertical counter flow permits a preferable, more intimate mixing of the air and water stream, and further facilitates transportation of the air stream to the supply plenum above the spray booth 20, thus allowing more efficient distribution of conditioned air within the booth.

In accordance with the present invention, only temperature sensors are required for conditioning the air, thereby eliminating the need for humidity or moisture sensors. One temperature sensor 71 is utilized in the circulation conduit between the saturator sump and the water spray nozzles or, alternatively, in the duct 50 downstream of the saturator. As required, heat may be added to or removed from the recirculating water to maintain the saturator water, and thereby the air effluent from the saturator, at the required temperature level. In addition, a second sensor 72 may be used in the duct 50 immediately downstream of reheater 68 to adjust the amount of heat added after adiabatic saturation. With these two simple and inexpensive sensors complete psychrometric control is obtained. Patent application Ser. No. 08/508,107, filed Jul. 27, 1995, and entitled Adiabatic Saturator And Method For Conditioning An Air Stream, discloses a suitable saturator 62, and its disclosure is incorporated herein by reference. As should now be apparent, however, other psychrometric control systems may also be employed or adapted for use as air conditioning system 60 according to the present invention. Such systems are disclosed in U.S. Pat. Nos. 4,197,714; 4,173,924 and 4,367,787, the disclosures of which are incorporated herein by reference.

In a preferred embodiment, the portion of the air stream exiting the saturator/scrubber which is to be recirculated is conditioned, off-line, prior to entry back into the system. The evaporative cooling taking place in the scrubber causes air flowing through the scrubber to increase in temperature, and to decrease in relative humidity. It has been found advantageous, therefore, to blend this air, prior to its recirculation back within the system, with a lesser amount of drier, cooler air, to provide an overall air supply that needs little or no psychrometric conditioning upon its recirculation back within the saturator. Automated control systems can be used to achieve this psychrometric blending, which has been found to be more efficient than simply recirculating the air from the saturator directly back into the system.

Figure 2:
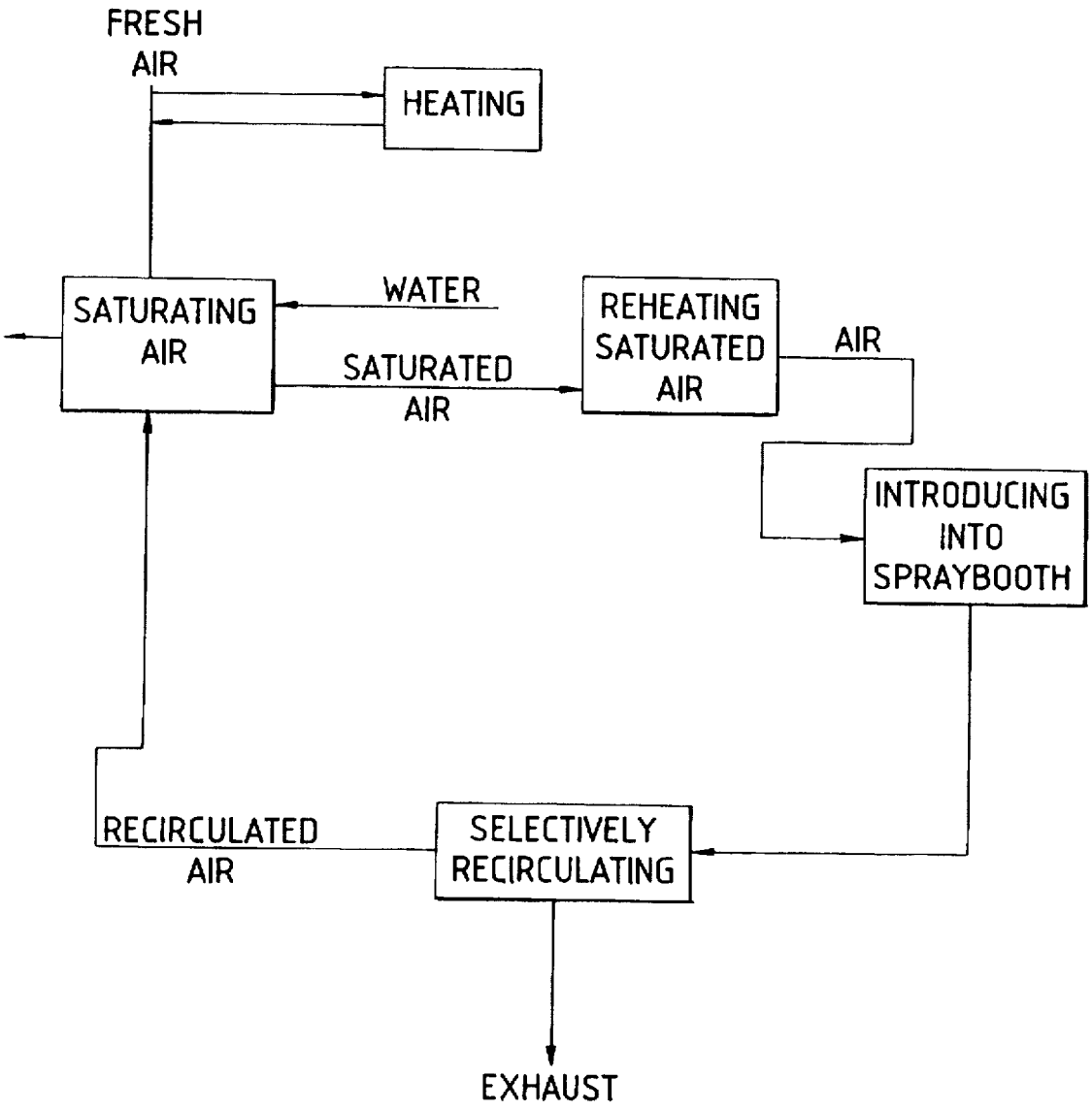
FIG. 2 shows a schematic diagram of the process of the invention.

The corresponding steps of the process of the invention shown in FIG. 2 include a first step of saturating an air stream by intimately mixing the air stream with water. The second step of the process involves heating the air stream with a relatively constant amount of heat. The amount of heat added is directly proportional to the mass flow of the air through the saturator, i.e., constant mass air flow will result in a constant amount of heat added to the air stream exiting the spray tower. Third, the process entails the step of introducing the air stream into a spray booth or similar paint application zone. Fourth, the process includes selectively recirculating a portion of the "used" air stream back into the saturating step of the process.

Alternatively, during cold weather conditions, the process can require the additional step of heating fresh air with a heating coil or a preferably a burner prior to saturating the air. Likewise, during extremely warm weather conditions, this process can include chilling the water to be used in the scrubbing step. The heat removed from the water stream can, in turn, be used as the energy supply for the heating step of the process. Ultimately, the process can further include a single control step that selectively achieves any desired psychrometric state for the air stream merely by adjusting the temperature of the scrubbing water.

Of course, it should be noted that various changes and modifications to the preferred embodiments of this invention will be apparent to those skilled in the art, such changes and modifications can be made without departing from the spirit and scope of the present invention. For instance, one further alternative embodiment would use wetted media or sprayed coils in order to achieve psychrometric control. By using several as such devices in series and bringing them in contact with water of a preselected temperature, such items could be used to achieve adiabatic saturation of the air stream. It is, therefore, intended that such changes and modifications be covered by the following claims.

What is claimed is:

1. An integrated paint spray booth and air conditioning system comprising:

(a) a longitudinally extending spray booth housing with opposed side walls, a top and a bottom defining a paint application zone, said top and bottom having passages to accommodate an air flow passing downward through said paint application zone;

(b) a scrubber chamber extending longitudinally below said paint application zone and having an inlet for receipt of paint laden air discharged from the housing and an outlet for the air leaving the scrubber chamber;

(c) a filtering chamber communicating with the outlet of the scrubber chamber and extending longitudinally and substantially coextensive with said scrubber chamber at least partially below said paint application zone, said filtering chamber including a plurality of air filters arranged longitudinally therein and an outlet located opposite to the scrubber chamber for the discharge of filtered air;

(d) a duct extending from said filtering chamber outlet to an air circulation system having an output communicating with the top of said spray booth housing;

(e) means in fluid communication with said duct to condition the air to a predetermined temperature and humidity prior to introduction into the housing, wherein said air conditioning means comprises an adiabatic saturator, a demister and a reheater, wherein said adiabatic saturator is at least in part a vertically standing packed tower arranged for a downward flow of water and a flow of air therethrough;

(f) whereby air is circulated from said housing and through the scrubber chamber, filter chamber and duct and returned to said housing in a path that is substantially transverse to the length of said spray booth housing.

2. The integrated paint spray booth and air conditioning system of claim 1 further comprising means for supplying fresh air to said air conditioning means.

3. The integrated paint spray booth and air conditioning system of claim 2 further comprising means for filtering the fresh air prior to delivery into the air conditioning means.

4. The integrated paint spray booth and air conditioning system of claim 1 further comprising means located between the filtering chamber and the air conditioning means for exhausting at least a part of the air discharged from the filtering chamber to atmosphere.

5. The integrated paint spray booth and air conditioning system of claim 4 further comprising means for supplying fresh air to said air conditioning means, and means for balancing the air flow in the system by controlling the quantity of fresh air introduced into the system and/or the quantity of air exhausted from the system.

6. The integrated paint spray booth and air conditioning system of claim 1 wherein said plurality of filters are arranged in a plurality of longitudinally extending filter banks, each said filter bank extending generally parallel to the longitudinal axis of said housing.

* * * * *